US006960113B2

(12) United States Patent
Munoz Urrea

(10) Patent No.: US 6,960,113 B2
(45) Date of Patent: Nov. 1, 2005

(54) INFLATABLE PLUSH TOY

(75) Inventor: Juan Salvador Munoz Urrea, Gava (ES)

(73) Assignee: Victory Products, S.L., Gava (ES)

( * ) Notice: Subject to any disclaimer, the term of this patent is extended or adjusted under 35 U.S.C. 154(b) by 0 days.

(21) Appl. No.: 10/889,436

(22) Filed: Jul. 13, 2004

(65) Prior Publication Data

US 2005/0130555 A1 Jun. 16, 2005

(30) Foreign Application Priority Data

Dec. 10, 2003 (EP) ..... 03380286

(51) Int. Cl.[7] ..... A63H 3/06
(52) U.S. Cl. ..... 446/224; 446/226
(58) Field of Search ..... 446/220, 221, 446/224, 226

(56) References Cited

U.S. PATENT DOCUMENTS 1,634,189 A * 6/1927 Henry ..... 446/226
3,664,401 A * 5/1972 Trovati ..... 156/145
4,242,830 A * 1/1981 Hauser ..... 446/226
4,687,458 A * 8/1987 Handa ..... 446/222
4,917,382 A * 4/1990 Hendershott ..... 473/567
5,597,339 A * 1/1997 Spector ..... 446/226
5,613,892 A * 3/1997 Barton ..... 446/226
5,895,309 A * 4/1999 Spector ..... 446/220
5,961,426 A * 10/1999 Spector ..... 482/83

FOREIGN PATENT DOCUMENTS

GB 2214830 A * 9/1989 ..... A63H 3/06

* cited by examiner

*Primary Examiner*—Bena Miller
(74) *Attorney, Agent, or Firm*—Jacobson Holman PLLC

(57) ABSTRACT

A toy has an interior bag made of an airtight, flexible material, the configuration of which adapts closely to the shape of the toy in its final form. The bag includes an air valve, accessible from the outside and located in a place that is not easily visible, together with a closure cap, in order to facilitate the filling of the toy with air, or the expelling of the air, as desired.

1 Claim, 1 Drawing Sheet

INFLATABLE PLUSH TOY

FIELD OF THE INVENTION

The present invention consists of an "Inflatable plush toy".

BACKGROUND

Plush toys are grotesque figures, generally of animals, their essential characteristics being their softness to the touch and ease of elastic deformability. This latter property is achieved by their stuffing, consisting of a soft material (for example, polyester).

At the present time, these toys are normally imported from countries with low-cost labour as, due to the high number of pieces comprising their morphology and the relative complexity of their assembly, the labour component of the cost of the toy is very high.

Furthermore, the transportation of the goods from the country that manufactures them to the country marketing them is also a significant component of the cost, as these are items in which the volume/weight proportion is very high.

In order to reduce the impact of the transportation cost on the price of the toy, occasionally (particularly when a relatively large size is involved) recourse is had to the purchase at source of the outside covering of the toy only, in order to stuff and close it in the country of destination.

SUMMARY OF THE INVENTION

The purpose of the invention consists of the elimination of the drawbacks of an economic nature that affect the manufacture and marketing of plush toys at the present time, according to the preceding description.

For this purpose, an arrangement has been made for the outside covering of the toy to contain an internal bag made of an airtight flexible material (PVC, latex, etc.), the configuration of which adapts closely to the shape of the toy itself in its final form, with a conventional air valve on the bag accessible from the outside and located in a place that is not easily visible, together with its means of closure, in order to facilitate the filling of the toy with air, or the expelling of the air, as desired.

With this arrangement, a number of cost advantages are obtained, which are claimed below:

Elimination of the stuffing material.

Elimination of the stuffing and closing operations.

Reduction in the cost of freight and haulage.

BRIEF DESCRIPTION OF THE DRAWING

In order to supplement the description of the invention and facilitate the interpretation of the formal, structural and functional characteristics of its object, a drawing is attached, on which a sketch is made of the aspect of a preferred implementation of an "Inflatable plush toy", which constitutes the object of this Patent, in a longitudinal cross-section view.

DESCRIPTION OF A PREFERRED EMBODIMENT

Figure 1:
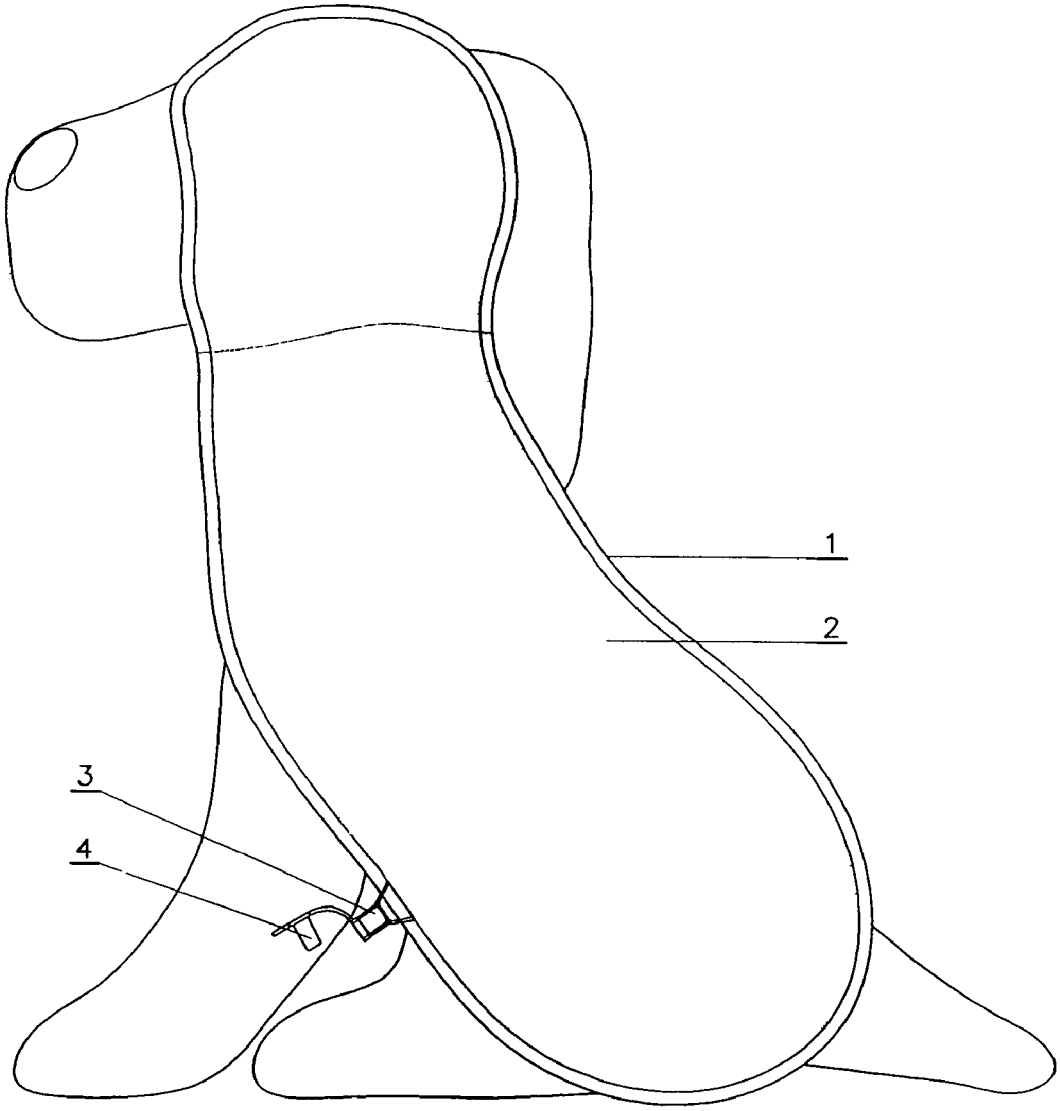

In order to clearly show the nature and scope of the advantageous application of the "Inflatable plush toy", which constitutes the object of the invention claimed, its structure and the arrangement of its elements are described hereunder, making reference to the drawing, which, on representing a preferred implementation of the said object, on an illustrative basis, must be considered in the broadest sense and not as restricting the application and the content of the invention claimed.

The exterior covering (1) of the toy has an interior bag (2) of an airtight, flexible material, the configuration of which adapts closely to the shape of the toy in its final form, while the said bag (2) includes a conventional air valve (3), accessible from the outside and located in a place that is not easily visible, together with its means of closure (cap) (4), in order to facilitate the filling of the toy with air, or the expelling of the air, as desired.

What is claimed is:

1. Inflatable plush toy, comprising an exterior covering having a central body portion and appendages, and an interior bag located in only said central body portion and being made of an airtight, flexible material, the configuration of the interior bag, in an expanded form, is shaped close to a shape of the central body portion in a final form, said interior bag including an air valve extending through the exterior covering and being accessible from outside the exterior covering and being located in a place that is at least partially hidden by at least one of the appendages, said air valve including a closure cap to facilitate filling of the toy with air and expelling of the air from the toy.

* * * * *